US009388684B2

(12) United States Patent
Robertson et al.

(10) Patent No.: US 9,388,684 B2
(45) Date of Patent: Jul. 12, 2016

(54) MODULATED FORMATION PERFORATING APPARATUS AND METHOD FOR FLUIDIC JETTING, DRILLING SERVICES OR OTHER FORMATION PENETRATION REQUIREMENTS

(71) Applicant: Robertson Intellectual Properties, LLC, Arlington, TX (US)

(72) Inventors: Michael C. Robertson, Arlington, TX (US); William F. Boelte, New Iberia, LA (US); Douglas J. Streibich, Forth Worth, TX (US)

(73) Assignee: Robertson Intellectual Properties, LLC, Burleson, TX (US)

( * ) Notice: Subject to any disclaimer, the term of this patent is extended or adjusted under 35 U.S.C. 154(b) by 259 days.

(21) Appl. No.: 13/815,691

(22) Filed: Mar. 14, 2013

(65) Prior Publication Data

US 2014/0262270 A1 Sep. 18, 2014

(51) Int. Cl.

| | |
|---|---|
| ***E21B 29/02*** | (2006.01) |
| ***E21B 43/11*** | (2006.01) |
| ***E21B 43/119*** | (2006.01) |
| ***E21B 47/09*** | (2012.01) |

(52) U.S. Cl.
CPC ..... *E21B 47/09* (2013.01); *E21B 43/11* (2013.01)

(58) Field of Classification Search
CPC ..... E21B 23/14; E21B 29/02; E21B 43/119; E21B 43/11
See application file for complete search history.

(56) References Cited

U.S. PATENT DOCUMENTS

| | | | | |
|---|---|---|---|---|
| 4,598,769 | A | 7/1986 | Robertson | |
| 5,035,285 | A * | 7/1991 | Dickinson et al. | 166/65.1 |
| 5,435,394 | A | 7/1995 | Robertson | |
| 5,564,499 | A * | 10/1996 | Willis et al. | 166/299 |
| 6,186,226 | B1 | 2/2001 | Robertson | |
| 6,598,679 | B2 | 7/2003 | Robertson | |
| 6,695,056 | B2 * | 2/2004 | Haugen et al. | 166/297 |
| 6,925,937 | B2 | 8/2005 | Robertson | |
| 7,284,489 | B2 * | 10/2007 | Bell et al. | 102/319 |
| 7,690,428 | B2 | 4/2010 | Robertson | |
| 7,726,392 | B1 | 6/2010 | Robertson | |
| 8,020,619 | B1 | 9/2011 | Robertson et al. | |
| 8,196,515 | B2 | 6/2012 | Robertson et al. | |
| 8,235,102 | B1 | 8/2012 | Robertson | |
| 8,327,926 | B2 | 12/2012 | Robertson | |
| 2010/0044025 | A1 | 2/2010 | Martindale | |
| 2010/0258292 | A1 * | 10/2010 | Tiernan et al. | 166/63 |
| 2012/0006547 | A1 | 1/2012 | Robertson et al. | |
| 2013/0299174 | A1 * | 11/2013 | Baski | 166/308.1 |

OTHER PUBLICATIONS

International Search Report and Written Opinion regarding corresponding PCT Application No. PCT/US2014/029088, dated Sep. 18, 2014.

* cited by examiner

*Primary Examiner* — Catherine Loikith

(57) ABSTRACT

Apparatus, systems, and methods, for perforating a downhole object while minimizing collateral damage to other objects, include use of a perforating device having a body, at least one fuel source having a characteristic that produces a selected mass flow rate, a selected burn rate, or combinations thereof, and an initiator for reacting the fuel to project a force through at least one port in the body. Characteristics of the at least one fuel source can include use of differing fuel types, shapes, and placement to achieve the desired mass flow rate or burn rate, and thus, a controlled force from the apparatus. An anchor or similar orienting device can be used to control the direction and position from which the force exits the apparatus. Openings formed in downhole objects can include a chamfered profile for facilitating future orientation or for injecting or removing substances from a formation.

20 Claims, 2 Drawing Sheets

MODULATED FORMATION PERFORATING APPARATUS AND METHOD FOR FLUIDIC JETTING, DRILLING SERVICES OR OTHER FORMATION PENETRATION REQUIREMENTS

FIELD

The present invention relates, generally, to systems and methods usable to perforate a barrier within a wellbore or other downhole component or object. Embodiments further relate to systems having a modulated, throttled velocity of work flow usable to eliminate formation damage and near-wellbore damage typically caused by explosives.

BACKGROUND

During well construction and other downhole operations, it is common for penetrations (e.g., perforation operations) to be necessary to open a wellbore or other cavity to the surrounding annulus and/or to open the wellbore or other cavity to a geological face or other environment.

Typically, drilling equipment or perforator systems require use of high energy force applications, mostly through the use of explosives. When utilizing mechanical drilling systems, there is a propensity to undercut, requiring added time and deployments, or to overcut, likely rendering the well feature irreparably damaged. Use of explosives has long been known to generate considerable collateral damage to the cement and formation in the vicinity of the penetrator. Near wellbore damage can result in drastic reductions in wellbore inflow of pay material, and in some instances can result in the migration of pay material or contaminants into adjacent zones, sometimes referred to as "thief zones."

A need exists for systems and methods that are usable for generating a perforation through a casing element to eliminate excessive damage to the casing, cement, and/or the formation.

A further need exists for systems and methods that are usable for creating a penetration through a wellbore or other element having an advantageous "exit chamfer" profile, in which the systems and methods are also usable for future exiting of tool systems, broaching into the backside geology for material recovery, or injection of materials/fluids into a formation.

A need also exists for systems and methods that are capable of modulating the amount of energy applied to a structural member to affect the proper chamfer, breach depth, and formation erosion.

A need also exists for systems and methods that are able to produce a throughput in a structural member, which does not produce occlusive debris, possibly occluding the desired perforation.

A need also exists for systems and methods that are able to produce multiple penetrations in a single deployment when deployed according to the physical characteristics of the perforation zone, based on temperature, pressure, and fluid medium.

A need also exists for systems, methods, and apparatus capable of producing penetrations on multiple planes in a single deployment.

A need also exists for systems and methods of orienting perforations within wellbores and other cavities that are presented in horizontal, vertical, or diagonal composition.

A need also exists for systems and methods, capable of the above, that can be activated using multiple methods, such as electric wireline, slickline (trigger), and pressure firing, as well as existing conventional methods.

A need also exists for systems and methods that are capable of perforating target components without relying on features of the target, other than the outside diameter. This performance measure indicates that the target material thickness does not affect the quality of the perforation, enabling embodiments of the present invention to be used as a "one size fits all" operation within diameter families.

An additional need exists for a perforation system that contains oriented fuel, such that the orientation of a burn-rate can accelerate or retard the mass flow rate.

An additional need exists for a perforating system having a velocity that can be modulated by varying the fuel type and position with respect to other fuels having faster or slower reaction rates. The physical geometry of the fuel can also be modified or chosen to produce a progressive or non-progressive burn rate. Additionally, multiple fuel types can be modeled such that layered fueled can be utilized.

Embodiments of the present invention meet these needs.

SUMMARY

Embodiments of the present invention relate, generally, to systems and methods usable to perforate a barrier within a wellbore or other cavity bearing component. Embodiments can include systems and/or apparatus having a modulated, throttled velocity of mechanical work usable to eliminate formation and near-wellbore damage and develop an enhanced chamfer feature upon which to orient wellbore exiting components (e.g., fluids, sand slurry, drilling mechanisms, and/or other substances or objects). As such, embodiments described herein can be used to form one or more openings in a downhole object (e.g., casing), without undesirably damaging additional downhole objects (e.g., cement and/or the formation). The openings can be provided with any desired shape and/or orientation, including a chamfer profile which can be used for future orientation of subsequent components, such as a water jet or similar tool usable to penetrate into the formation, e.g., for production or injection purposes.

In an embodiment, the perforating apparatus, used to form at least one opening in a first downhole object (e.g., casing, tubular conduits), without undesirably damaging a second or additional downhole object(s) (e.g., cement, a producing formation, a geological formation), includes a body having at least one port formed therein, and at least one fuel source disposed in the body. The at least one fuel source can include a characteristic, which produces a selected mass flow rate, a selected burn rate, or combinations thereof, that are adapted to form the at least one opening in the first downhole object while minimizing collateral damage to the second or additional downhole object. The perforating apparatus can further include an initiator, in communication with the at least one fuel source, which causes the at least one fuel source to produce the selected mass flow rate, the selected burn rate, or combinations thereof and to project a force through the at least one port to form the at least one opening in the first downhole object.

In an embodiment of the invention, the perforating head can have one or a plurality of discharge ports, which can include one or more slots, a singular hole, a matrix or plurality of holes having a proximity to one another that can produce an additive effect, or other port configurations depending on the characteristics of the object to be perforated and/or other wellbore conditions. The size, shape, angle, and position of the ports can be selected to affect the shape and/or orientation of the openings formed in a segment of casing or other downhole object, such as by affecting the Mass flow rate therethrough.

The perforating head can be deployed in conjunction with an orienting "lug" usable to position toolstring members with a general face of the tool (e.g, the location of one or more discharge ports) facing away from the maximum gravitational vector, or in another desired orientation.

In an embodiment of the invention, the perforator head can possess a thermal barrier and a structural member.

In another embodiment of the invention, the perforator head can contain a dual use head section having a cavity filled with a wellbore fluid that can act as a mechanical dampener during initial fuel content expulsion. In a further embodiment, one or more of the ports can be occluded by the tool system operator in the field, which can allow the perforation pattern to be modified in-situ.

The tool apparatus can have selected mass flow as directed by the operator of the tool system. The mass flow expectation is a function of the target material removal volume, the geometric basis of the tool to target size ratio, the hydrostatic pressure at the perforation, the temperature of the perforation location, the presence or lack or circulation within the wellbore, and the presence or lack of vertical wellbore condition. Specifically, in an embodiment, the fuel load of the apparatus can be configured to provide a desired mass flow and/or burn rate, e.g., through use and relative orientation between different fuel types, and/or fuel sources having differing shapes or physical geometries. The mass flow and/or burn rate can be selected based on various wellbore conditions, the thickness of the downhole object to be perforated (e.g., the outer diameter of a segment of casing), such that an opening having the desired shape can be formed without damaging other downhole objects (e.g., the cement or formation).

In an embodiment, the toolstring apparatus can contain an anchoring system for allowing selective prepositioned anchoring with respect to wellbore depth in proximity to a target zone, and/or the ability to be oriented radially about a wellbore for directional perforation applications. Such depth fixation and directional (azimuthal) locking allows for the energy delivered by the tool to act in the most advantageous direction for well production or injection. This capability becomes very productive when an expectation of horizontal perforations (180 degree phasing) is posed while in a horizontal or substantially horizontal phase of a wellbore, enabling operation to be performed with characteristics specific to horizontal and/or lateral production zones. In events where canted fissures or geologic patterns exist, the tool system can be directed and fixed in a position usable for up thrust conditions.

In another embodiment of the invention, the perforating system can have an activating system utilized to begin the fuel load burning process. A common device used for this process is a Thermal Generator (THG), available from MCR Oil Tools. THG systems can be activated using electrical current produced at the surface through electric wireline (E-line), with a downhole triggering unit generating current from a battery pack and conveyed on slickline, and/or using a "CP Initiator" or similar device delivered on coiled tubing or pipe.

The systems, methods, and apparatus described herein can thereby be used to perforate an object (e.g., a segment of casing) within a wellbore while minimizing or eliminating undesired damage to cement, the formation, and/or other near-wellbore damage, e.g., through use of a modulated, throttled velocity of mechanical work. The perforations formed can include an enhanced chamfer feature upon which substances and/or components (e.g., fluid, slurries, and drilling mechanisms) can be oriented and/or passed therethrough. This enhanced chamfer feature is also usable for later exiting of tool systems, broaching into the backside geology for material recovery, and/or injecting materials and/or fluids into a formation. In addition to eliminating excessive cement or formation damage, use of the present systems, methods, and apparatus can avoid production of occlusive debris that can hinder the operation of one or more perforations in the apparatus, and/or hinder other wellbore operations. The characteristics of the chamfer, the breach depth, and the amount of formation erosion can be controlled through modification of the amount of energy applied to a structural member, e.g., through use of the modulated, throttled velocity, described above, which can be performed through selection and orientation of the fuel load, selection and orientation of ports in the perforator, and positioning of the perforator relative to the object to be perforated (e.g., the offset).

The resulting systems, methods, and apparatus can thereby have the ability, when deployed according to the physical characteristics of the perforation zone, e.g., based on temperature, pressure, and/or fluid medium, to produce multiple penetrations, or penetrations on multiple planes, in a single deployment, as well as to orient the perforations within well bores and other cavities, that are presented in horizontal, vertical, or diagonal composition.

BRIEF DESCRIPTION OF THE DRAWINGS

In the detailed description of various embodiments of the present invention presented below, reference is made to the accompanying drawings, in which.

Embodiments of the present invention are described below with reference to the listed Figures.

DETAILED DESCRIPTION OF THE EMBODIMENTS

Before explaining selected embodiments of the present invention in detail, it is to be understood that the present invention is not limited to the particular embodiments described herein and that the present invention can be practiced or carried out in various ways.

Embodiments usable within the scope of the present disclosure relate, generally, to systems and methods usable to perforate a barrier within a wellbore or other cavity bearing component. Embodiments further include systems and/or apparatus having a modulated, throttled velocity of mechanical work usable to eliminate formation and near-wellbore damage and to develop an enhanced chamfer feature upon which wellbore exiting components can be oriented, including fluids, sand slurry, drilling mechanisms, and other components.

Systems and methods usable within the scope of the present disclosure can thereby generate a perforation through, e.g., a casing element, that eliminates excessive damage to the conduit (casing), cement, and/or formation, in addition to avoiding production of occlusive debris that could occlude or otherwise interfere with the perforation.

Embodiments usable within the scope of the present disclosure can further create a penetration through a wellbore, conduit, or other barrier element having an advantageous "exit chamfer" profile usable for later tool system exiting, broaching into the backside geology for material recovery, and/or injecting materials/fluids into a formation, as embodied systems and methods can be capable of modulating the amount of energy applied to a structural member to affect the proper chamfer, breach depth, and formation erosion.

In addition, embodiments usable within the scope of the present disclosure can possess the ability, when deployed according to the physical characteristics of a perforation zone (e.g., temperature, pressure, fluid medium), to produce multiple penetrations and/or penetrations in multiple planes, in a single deployment, and to orient the perforations within wellbores or other cavities, that are presented in horizontal, vertical, or diagonal composition.

Figure 1A:
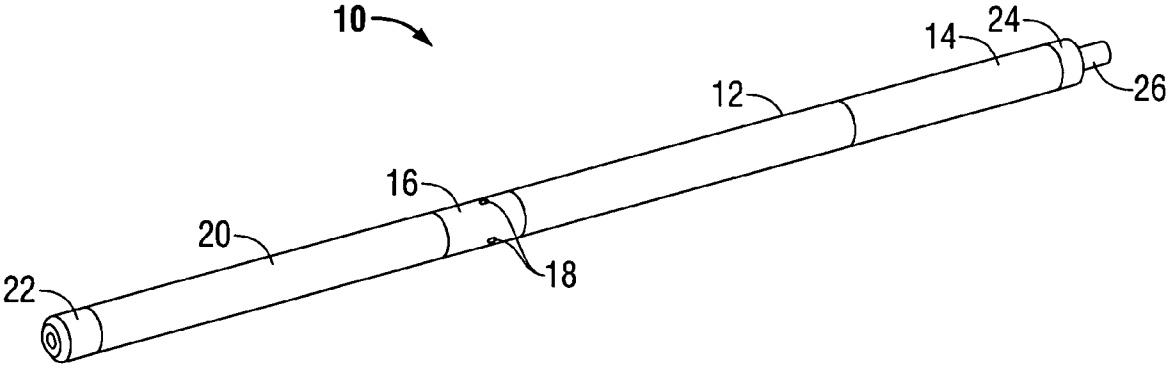
FIG. 1A depicts an isometric view of an embodiment of a perforating apparatus usable within the scope of the present disclosure to perforate a barrier within a wellbore or other cavity bearing component.
Figure 1B:
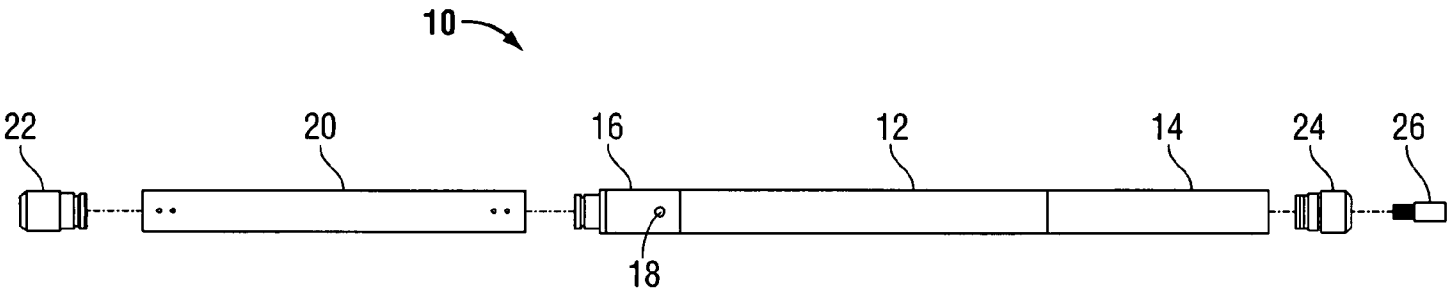
FIG. 1B depicts a side disassembled view of the perforating apparatus of FIG. 1A.

Referring now to FIGS. 1A and 1B, an embodiment of a perforating apparatus (10) usable within the scope of the present disclosure is depicted. Specifically, FIG. 1A depicts an isometric view of the perforating apparatus (10), while FIG. 1B depicts a disassembled side view thereof.

The perforating apparatus (10) is shown having a perforator body (12), depicted as a generally tubular (e.g., cylindrical) member, having a fuel extension (14) at one end and a perforating head (16) at the opposing end. While FIGS. 1A and 1B depict the perforator body (12), fuel extension (14), and perforating head (16) as separate components that can be connected together (e.g., via threaded connections, force and/or snap fit, welding, etc.), in various embodiments, one or more parts of the perforating apparatus (10) can be integral and/or otherwise formed as a single piece. Similarly, any portions thereof can include multiple parts to facilitate transport, storage, and/or manufacture.

The fuel extension (14) can be provided with one or more types of fuel (e.g., varying grades and/or compositions of thermite or similar non-explosive, ignitable substances, and/or other types of generally non-explosive substances usable to produce a force when ignited or otherwise reacted), the types of fuel being arranged and/or oriented to control the rate of exodus of mass and/or force from the fuel extension (14) and the propagation thereof through the perforator body (12). For example, the position of certain types of fuel can be varied with respect to other types of fuels having faster or slower reaction rates. The physical geometry of the fuel (e.g., the shape of solid thermite pellets and/or discs) can be chosen based on the desired progressive or non-progressive burn rate. Additionally, one or more fuel types can be layered. The fuel extension (14) and/or the perforator body (12), while depicted as tubular components, can include various internal features and/or material characteristics to desirably affect the propagation of mass and/or force therein, and/or the burn rate of various contents.

The perforator head (16) is shown having multiple ports (18) (e.g., slots, holes, orifices, or other types of openings) therein. It should be understood that each depicted port (18) can be representative of one opening or multiple closely-spaced openings. Further, it should be understood that while FIGS. 1A and 1B depict multiple, generally rectangular slots in the perforator head (16), any number and placement of ports can be provided, and the ports (18) can have any shape and/or angle, depending on the direction and desired propagation of force and/or mass therethrough. In an embodiment, the ports (18) can include one or more matrices of holes spaced such that discharge therethrough provides an additive effect. The number, shape, orientation, and position of the ports (18) can be selected to desirably affect the mass flow rate therethrough, and subsequently, the formation of an opening in a downhole object. Embodiments can also include one or more internal features usable to occlude (e.g., wholly or partially block/obstruct) one or more ports, to enable selective control of force and/or mass produced by reacting fuel within the perforating apparatus (10). Such internal features can be remotely actuated and/or directly actuated (e.g., through use of an electric line, a slick line, other forms of control lines, and/or through shearing of pins and/or other frangible members), such that a movable physical barrier is moved into a position that occludes one or more of the ports (18).

An anchor (20), such as a pressure balance anchor available from MCR Oil Tools, or a similar type of anchoring device, is shown engaged with the perforating head (18) for facilitating positioning of the perforating apparatus (10) at a selected depth and/or within a selected zone of a wellbore. The anchor (20) can be used to radially orient the perforating apparatus (10), e.g., when it is desired to perforate in a desired direction by positioning and orienting the ports (18) in the desired direction, and/or to control the offset between the perforating apparatus (10) and the object to be perforated. Fixation of the perforating apparatus (10) at a desired depth and in a desired directional (e.g., azimuthal) orientation allows the perforating apparatus (10) to be positioned to project mass and/or force through the ports (18) in a manner determined to be most advantageous for production or injection, especially when used within a horizontal portion of a wellbore. A bull plug (22) or any other manner of barrier and/or end cap can be provided at the end of the anchor (20), or alternatively, the anchor (20) could be formed with a closed end or similar external or internal barrier therein.

FIGS. 1A and 1B also depict a thermal generator (24) secured to the fuel extension (14). It should be understood that while a thermal generator (24), such as one available from MCR Oil Tools, is shown and described herein, other types of ignition and/or initiation devices can be used, depending on the type(s) of fuel used within the fuel extension (14), and any characteristics of the object to be cut and/or the wellbore environment. An isolation sub (26) is shown disposed at the opposing end of the thermal generator (24), for isolating and/or insulating the perforating apparatus (10) from other components along the same conduit and/or or within the wellbore.

It should be understood that the depicted arrangement and orientation of components is merely an exemplary embodiment, and that any of the components of the perforating tool (10) described above could be otherwise arranged, configured, or omitted. For example, while FIGS. 1A and 1B depict an anchor (20) disposed in a downhole direction from the perforating head (16), embodiments could include an anchor (20) disposed uphole from the perforating head (16), or use of an anchor (20) could be omitted when unnecessary. Similarly, while FIGS. 1A and 1B depict a thermal generator (24) disposed in an uphole direction from the perforator body (12) and fuel extension (14), in various embodiments, the thermal generator (24) or similar initiation and/or ignition source could be downhole from the perforator body (12). Similarly, the fuel extension (14) could be positioned downhole from the perforator body (12), and/or the perforating head (16) could be positioned uphole from the perforator body (12).

Figure 2A:
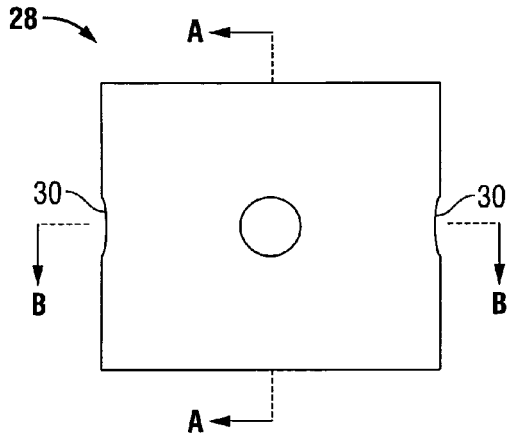
FIG. 2A depicts a side view of a tubular member having an opening formed using embodiments of an apparatus usable within the scope of the present disclosure.
Figure 2B:
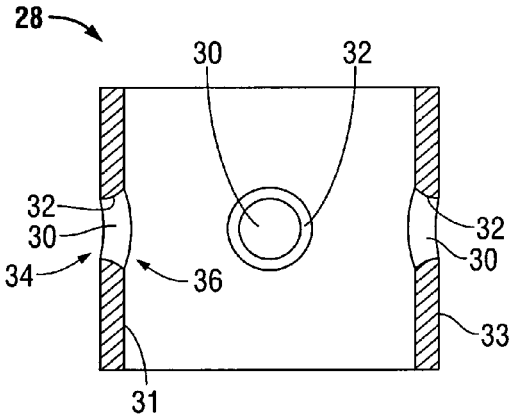
FIG. 2B depicts a side cross-sectional view of the tubular member of FIG. 2A, taken along line A-A.
Figure 2C:
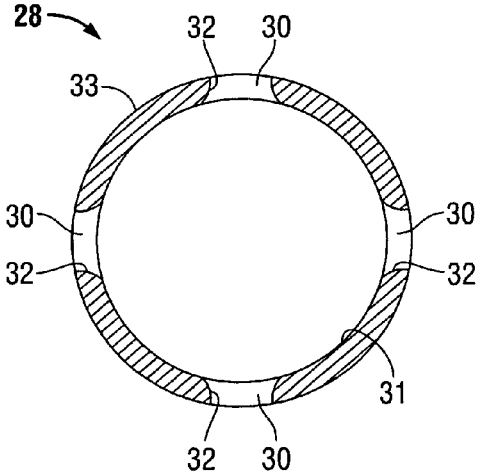
FIG. 2C depicts a top cross-sectional view of the tubular member of FIG. 2A, taken along line B-B.

Referring now to FIGS. 2A, 2B, and 2C, an embodiment of an opening (30) formed in a tubular member (28) (e.g., a joint of casing) using embodiments of apparatuses usable within the scope of the present disclosure, is shown. Specifically, FIG. 2A depicts a side view of the tubular member (28), FIG. 2C depicts a top cross-sectional view thereof, taken along line B-B, and FIG. 2B depicts a side cross-sectional view thereof, taken along line A-A. As described previously, openings formed using embodiments described herein can be provided with a desired shape, e.g., an "exit chamfer" feature, which can be used for future locating and positioning of tools, and for advantageously exiting the tubular member (28) into the formation (e.g., for injection or extraction operations) using subsequent tools.

FIGS. 2A, 2B, and 2C depict the tubular member (28) having four openings (30) formed therein, each opening (30) disposed approximately ninety degrees about the circumference of the tubular member (28) from each adjacent opening (30). It should be understood, however, that embodiments usable within the scope of the present disclosure can create any number of openings in an object, and that the resulting openings can have any desired position and/or orientation relative to one another. Further, while FIGS. 2A, 2B, and 2C depict openings (30) having the "exit chamfer" profile described above, it should be understood that various embodiments could provide any desired shape to the openings (30), e.g., to facilitate subsequent locating and positioning operations.

Each opening (30) is shown having a chamfered surface (32) extending between the outer diameter (33) and the inner diameter (31) of the tubular member (28). The chamfered surface (32) is shown having a generally curved, angled, and/or sloped shape, which can be curved, angled, and/or otherwise sloped, thereby providing the openings (30) with an outer end (34) having a diameter narrower than that of their inner end (36). The curve and/or angle of the chamfered surfaces (32) facilitates future location and positioning of tools, e.g., through use of objects having protrusions adapted to locate and/or engage the openings (30). Additionally, the chamfered surfaces (32) provide a contour suitable for orienting subsequent tools, usable to bore into the adjacent cement and/or formation, extract substances therefrom, and/or inject substances therein.

While various embodiments of the present invention have been described with emphasis, it should be understood that within the scope of the appended claims, the present invention might be practiced other than as specifically described herein.

What is claimed is:

1. A perforating apparatus comprising:

a body configured to contain:

at least one non-explosive fuel source disposed in the body comprising a first fuel type configured to produce a first mass flow rate and a first burn rate, and a second fuel type configured to produce a second mass flow rate and a second burn rate, wherein at least one of the first flow rate and the first burn rate is different from the second mass flow rate and the second burn rate;

an initiator configured to initiate a burn of said at least one non-explosive fuel source, causing said at least one non-explosive fuel source to produce a force comprising a selected mass flow rate, a selected burn rate, or combinations thereof, that selectively changes from the first mass flow and the first burn rate to the second mass flow and the second burn rate while the non-explosive fuel source is burning; and a port configured to project the force to form an opening in a first downhole object while minimizing collateral damage to at least one second downhole object, wherein the at least one port is configured to direct the force as change occurs in the selected mass flowrate, the selected burn rate, or combinations thereof.

2. The apparatus of claim 1, wherein said at least one port comprises a matrix of openings spaced such that flow through a first opening provides an additive effect when combined with flow through at least one second opening.

3. The apparatus of claim 1, wherein said at least one port comprises a closable opening.

4. The apparatus of claim 1, wherein said at least one fuel source comprises thermite.

5. The apparatus of claim 1, wherein the selected mass flow rate, the selected burn rate, or combinations thereof is determined by a characteristic of said at least one fuel source, wherein the characteristic comprises a type of fuel, a physical geometry of fuel, a position of a first type of fuel relative to a second type of fuel, a position of said at least one fuel source relative to said at least one port, or combinations thereof.

6. The apparatus of claim 1, wherein said first downhole object comprises a tubular conduit.

7. The apparatus of claim 1, wherein said at least one second downhole object comprises cement, a producing formation, a geological formation, or combinations thereof.

8. The apparatus of claim 1, wherein the initiator comprises a thermal generator.

9. The apparatus of claim 1, further comprising an anchor secured to the body, wherein the anchor is adapted to secure the body at a selected depth within a wellbore, to provide a selected rotational orientation to the body for directional perforation operations, or combinations thereof.

10. The apparatus of claim 9, wherein the anchor comprises a pressure balance anchor.

11. A method for perforating a downhole object, the method comprising the steps of:

providing a perforating apparatus having at least one non-explosive fuel source disposed therein, wherein said at least one non-explosive fuel source comprises a first fuel type configured to produce a first mass flow rate and a first burn rate, and a second fuel type configured to produce a second mass flow rate and a second burn rate, wherein at least one of the first mass flow rate and the first burn rate is different from the second mass flow rate and the second burn rate;

reacting said at least one fuel source to produce a force comprising a selected mass flow rate, a selected burn rate, or combinations thereof that selectively changes from the first mass flow rate and the first burn rate to the second mass flow rate and the second burn rate while the non-explosive fuel source is burning; and directing the force from the perforating apparatus through a port configured to direct the force as change occurs in the selected mass flow rate, the selected burn rate, or combinations thereof, to form an opening in a first downhole object while minimizing collateral damage to at least one second downhole object.

12. The method of claim 11, further comprising the step of providing a plurality of types of fuel, a selected physical geometry of fuel, a position of a first type of fuel relative to a second type of fuel, or combinations thereof, into the perforating apparatus to provide the selected mass flow rate, the selected burn rate, or combinations thereof.

13. The method of claim 11, wherein the first downhole object comprises a tubular conduit, and wherein said at least one second downhole object comprises cement, a producing formation, a geological formation, or combinations thereof.

14. The method of claim 11, further comprising the step of securing the perforating apparatus at a fixed depth, a fixed rotational orientation, or combinations thereof.

15. The method of claim 14, wherein the step of securing the perforating apparatus at the fixed depth, the fixed rotational orientation, or combinations thereof, comprises using an anchor in communication with the perforating apparatus.

16. The method of claim 11, wherein the step of directing the force from the apparatus to form the opening in the first downhole object comprises forming a chamfered opening in the first downhole object.

17. The method of claim 16, further comprising using the chamfered opening to orient a downhole object, inject a substance into a well through the chamfered opening, remove a substance from a formation through the chamfered opening, or combinations thereof.

18. The method of claim 11, wherein the step of directing the force from the perforating apparatus to form the opening in the first downhole object comprises projecting the force in an upward direction.

19. The method of claim 11, further comprising positioning the perforating apparatus in a substantially horizontal region of a wellbore.

20. The method of claim 11, wherein the perforating apparatus includes at least one opening, and wherein the step of directing the force from the perforating apparatus to form the opening comprises at least partially occluding said at least one opening in the perforating apparatus.

* * * * *